US010358790B2

(12) United States Patent
Thompson

(10) Patent No.: US 10,358,790 B2
(45) Date of Patent: Jul. 23, 2019

(54) SOIL SPREADING SCRAPER DEVICE INCLUDING DEFLECTING PADDLES

(71) Applicant: Dynamic Ditchers Inc., Dugald (CA)

(72) Inventor: Mark Christopher Thompson, Dugald (CA)

(73) Assignee: Elmer's Welding & Manufacturing LTD., Altona (CA)

( * ) Notice: Subject to any disclaimer, the term of this patent is extended or adjusted under 35 U.S.C. 154(b) by 336 days.

(21) Appl. No.: 15/154,234

(22) Filed: May 13, 2016

(65) Prior Publication Data

US 2017/0022685 A1 Jan. 26, 2017

Related U.S. Application Data

(60) Provisional application No. 62/180,852, filed on Jun. 17, 2015.

(51) Int. Cl.

| | |
|---|---|
| ***E02F 5/02*** | (2006.01) |
| ***E02F 3/64*** | (2006.01) |
| ***E02F 3/65*** | (2006.01) |

(52) U.S. Cl.

CPC ..... *E02F 5/027* (2013.01); *E02F 3/649* (2013.01); *E02F 3/656* (2013.01)

(58) Field of Classification Search

CPC ... E02F 5/08; E02F 5/027; E02F 5/025; E02F 5/282; E02F 3/656; E02F 3/649; E02F 3/76; A01G 3/00; A01D 34/535

See application file for complete search history.

(56) References Cited

U.S. PATENT DOCUMENTS

| | | | | | |
|---|---|---|---|---|---|
| 1,349,353 | A * | 8/1920 | Wilber, Jr. | F01C 1/44 | 123/227 |
| 1,762,441 | A * | 6/1930 | Johnson | A01D 34/86 | 37/189 |
| 2,229,830 | A * | 1/1941 | White | B60C 27/045 | 152/216 |
| 2,245,545 | A * | 6/1941 | Miller | A47L 11/00 | 15/236.08 |
| 2,507,742 | A * | 5/1950 | Tuft | A01D 41/14 | 198/518 |
| 2,680,337 | A * | 6/1954 | Whipple | A01D 34/535 | 172/45 |
| 2,777,268 | A * | 1/1957 | Breed | A01D 34/535 | 172/45 |

(Continued)

*Primary Examiner* — Jessica H Lutz
(74) *Attorney, Agent, or Firm* — Ryan W. Dupuis; Ade + Company Inc.; Kyle R. Satterthwaite

(57) ABSTRACT

A soil spreading scraper device has a cutting blade to cut soil from the ground and a rotating impeller member for spreading the cut soil as the frame is displaced forwardly. The impeller member includes a main disc body and a plurality of impeller blades on the main disc body which are pivotal relative to the body between a working position in which the blade body extends in a direction of the impeller axis away from the main disc body and a deflected position in which the blade body extends in a circumferential direction of the disc body in a trailing relationship relative to the pivot axis of the blade body. An actuating assembly resists displacement of the blade body into the deflected position until pressure on the paddle exceeds a prescribed holding force. A spring biases the body to return to the working position.

16 Claims, 14 Drawing Sheets

(56) References Cited

U.S. PATENT DOCUMENTS 2,923,073 A * 2/1960 Baker ..... E02F 3/186 37/92
2,926,436 A * 3/1960 Humphreys ..... E02F 3/905 37/327
3,020,694 A * 2/1962 Foshee ..... A01G 3/002 172/45
3,181,619 A * 5/1965 Smith ..... A01B 39/166 172/123
3,574,989 A * 4/1971 Rousseau ..... A01D 34/866 37/189
3,589,500 A * 6/1971 Hansen ..... B65G 31/04 198/601
3,624,826 A * 11/1971 Rogers ..... E02F 5/282 172/108
3,645,553 A * 2/1972 Hinterholzer ..... A63C 11/24 280/824
4,113,027 A * 9/1978 van der Lely ..... A01B 33/025 172/123
4,170,079 A * 10/1979 Holekamp ..... E02F 3/905 37/318
5,113,610 A 5/1992 Liebrecht et al.
5,237,761 A * 8/1993 Nadeau ..... A01B 13/02 172/109
5,511,326 A * 4/1996 Liebrecht, Jr. ..... E02F 3/186 37/347
6,226,903 B1 * 5/2001 Erickson ..... E02F 5/027 172/149
7,627,964 B2 * 12/2009 Vaags ..... A01B 13/00 172/149
8,201,388 B1 * 6/2012 Vandeven ..... A01D 41/141 56/10.2 E
9,374,938 B2 * 6/2016 Thompson ..... A01B 49/022
2004/0231864 A1 * 11/2004 Newman ..... E02F 3/20 172/25
2011/0271653 A1 * 11/2011 Vandeven ..... A01D 41/141 56/10.2 E
2015/0250098 A1 * 9/2015 Vandeven ..... A01D 34/8355 56/52
2016/0153170 A1 * 6/2016 Thompson ..... A01B 59/04 37/91
2016/0360701 A1 * 12/2016 Weeks ..... A01D 61/008

* cited by examiner

SOIL SPREADING SCRAPER DEVICE INCLUDING DEFLECTING PADDLES

This application claims the benefit under 35 U.S.C.119(e) of U.S. provisional application Ser. No. 62/180,852, filed Jun. 17, 2015.

FIELD OF THE INVENTION

The present invention relates to a soil spreading scraper device which is arranged to cut a top layer of soil from the ground as the device is displaced along the ground in a forward working direction and which is arranged to spread the cut soil transversely to the forward working direction, and more particularly the present invention relates to a soil spreading scraper device in which a soil spreading impeller disc of the device includes blades which are deflectable from a working position to a deflected position by pivoting against a biasing member.

BACKGROUND

In some situations it is required to pick up soil at one location and transport it to another. In the case of road building for instance, the contour of the ground is changed to form a road by taking the soil from one location and placing it in another. Not only must the soil be removed from one location, it must also be placed in another specific location.

In many situations however, it is only desired to remove the soil from its current location, and the location it is moved to is not critical. Often it is desired to simply spread the removed soil so that it does not interfere with future operations on the land. An example is where ditches are made to drain standing water from ponds on agricultural lands.

Conventional soil moving machines include scrapers and loaders, where a generally horizontal blade is moved at a shallow depth along the ground, lifting soil and moving same into a bucket where it remains until dumped. Scrapers may incorporate a chain elevator to assist in moving the soil into the bucket. Trenchers or ditchers generally move the soil from the trench and pile it beside the trench, although ditchers are also known which spread the soil that is removed. Such soil-spreading ditchers are disclosed in U.S. Pat. Nos. 3,624,826 to Rogers, U.S. Pat. No. 5,237,761 to Nadeau et al., U.S. Pat. No. 5,113,610 to Liebrecht et al., and U.S. Pat. No. 6,226,903B1 to Erickson.

The soil moving machines of the prior art generally include a rotating impeller disc in which impeller blades on the disc which rotate with the disc can be subject to considerable damage if impacting rocks and other similar debris. U.S. Pat. No. 5,237,761 by Nadeau discloses the use of shear pins for fastening the blades to the disc to minimize damage to the blade upon impact with a rock, by allowing the blade to swing freely from a remaining fastener once the shear pin is broken. The blade is not functional however until the shear pin is replaced. Furthermore, the blade swings about a remaining fastener which is parallel to the disc axis of rotation such that the swinging blade can potential cause further damage to other elements of the implement. The orientation of the pivot axis of the blade also causes the blade body to bite into the main disc body in a twisting motion that may interfere with proper shearing of the shear pin causing unnecessary damage to the blade in some instance.

In other prior art soil-spreading ditchers, the blade must be replaced in its entirety subsequent to impact with a large rock or other similar debris.

SUMMARY OF THE INVENTION

According to one aspect of the invention there is provided a soil spreading scraper device comprising:

a frame supported for movement along the ground in a forward working direction;

a cutting blade supported on the frame so as to be arranged to cut soil from the ground as the frame is displaced in the forward working direction; and an impeller member supported on the frame rearward of the cutting blade for rotation about an impeller axis within a plane of rotation lying generally perpendicularly to the impeller axis, the plane of rotation extending generally upward at an angle from horizontal;

the impeller member comprising a main disc body and a plurality of impeller blades supported on the main disc body at circumferentially spaced apart locations about the impeller axis so as to be arranged to spread cut soil from the cutting blade generally radially outward from the impeller axis as the impeller member is rotated;

each impeller blade comprising:

a pivot shaft supported on the main disc body;

a blade body supported on the pivot shaft so as to be pivotal about a shaft axis of the pivot shaft between a working position in which the blade body extends from the pivot shaft in a direction of the impeller axis away from the main disc body and a deflected position in which the blade body extends from the pivot shaft in a circumferential direction of the disc body in a trailing relationship relative to the pivot shaft; and an actuating assembly which supports the blade body in the working position and resists displacement of the blade body from the working position to the deflected position until pressure on the paddle exceeds a prescribed holding force of the actuating assembly.

Preferably the shaft axis of each impeller blade is oriented primarily in a radial direction relative to the main disc body.

The shaft axis of each impeller blade is preferably oriented at an acute angle relative to a radial axis of the main disc body, within a plane lying perpendicular to the impeller axis.

Each actuating assembly may be arranged to apply a resistive force throughout a range of pivotal movement of the respective blade body between the working position and the deflected position in which the prescribed holding force of the actuating assembly in the working position is greater than the resistive force at an intermediate position between the working position and the deflected position.

Preferably each actuating assembly comprises a spring in which the spring may be arranged to bias the respective blade body from the deflected position towards the working position throughout a full range of motion of the blade body.

According to one embodiment, each actuating assembly may comprise a spring extending helically about the shaft axis, a first cam element supported pivotal movement with the blade body about the shaft axis and a second cam element supported for sliding movement in an axial direction along the shaft axis relative to main disc body in operative connection to the spring, in which at least one of the first cam element and the second cam element of each actuating assembly comprises a helical cam surface in sliding contact with the other cam element so as to be arranged to compress the spring as the blade body is pivoted from the working position to the deflected position. In this instance, both the first cam element and the second cam element may comprise a helical cam surface having matching helical angles. The second cam element may be guided to rotate about the shaft axis as the second cam element is slidably displaced in the axial direction in a non-linear relationship. In this instance, each actuating assembly may further comprise a pin supported on the pivot shaft in fixed relation to the main disc body and a slot on the second cam element which mates with the pin and dictates rotation of the second cam element about the shaft axis in relation to sliding movement in the axial direction.

According to a further embodiment, when each impeller blade further includes a base portion supported in fixed relation to the main disc body upon which the blade body is pivotally supported, the actuating element may comprises: i) a socket supported in fixed relation to one of the blade body and the base portion; and ii) a pin member supported on another one of the blade body and the base portion so as to be slidable in a direction of the shaft axis between an engaged position received within the socket within the working position of the blade body so as to resist displacement of the blade body from the working position and a disengaged position in which the pin member is removed from the socket and does not substantially resist displacement of the blade body between the working position and the deflected position. Preferably the pin member of each actuating assembly is spring biased towards the engaged position. The pin member may comprise a convex surface arranged to be engaged within the socket.

Alternatively, when each impeller blade further comprises a base portion supported in fixed relation to the main disc body upon which the blade body is pivotally supported, the actuating element may comprise a shear pin connected between the blade body and the base portion so as to be oriented in a direction of the shaft axis.

According to a second aspect of the present invention there is provided a soil spreading scraper device comprising:

a frame supported for movement along the ground in a forward working direction;

a cutting blade supported on the frame so as to be arranged to cut soil from the ground as the frame is displaced in the forward working direction; and an impeller member supported on the frame rearward of the cutting blade for rotation about an impeller axis within a plane of rotation lying generally perpendicularly to the impeller axis, the plane of rotation extending generally upward at an angle from horizontal;

the impeller member comprising a main disc body and a plurality of impeller blades supported on the main disc body at circumferentially spaced apart locations about the impeller axis so as to be arranged to spread cut soil from the cutting blade generally radially outward from the impeller axis as the impeller member is rotated;

each impeller blade comprising:

a pivot shaft supported on the main disc body;

a blade body supported on the pivot shaft so as to be pivotal about a shaft axis of the pivot shaft between a working position in which the blade body is operative to spread the cut soil and a deflected position in which the blade body is deflected about the shaft axis relative to the working position; and an actuating assembly which supports the blade body in the working position and resists displacement of the blade body from the working position to the deflected position until pressure on the paddle exceeds a prescribed holding force of the actuating assembly;

the actuating assembly comprising a spring which is arranged to bias the respective blade body from the deflected position towards the working position throughout a full range of motion of the blade body.

Preferably each actuating assembly is arranged to apply a resistive force throughout a range of pivotal movement of the respective blade body between the working position and the deflected position in which the prescribed holding force of the actuating assembly in the working position is greater than the resistive force at an intermediate position between the working position and the deflected position.

According to a third aspect of the present invention there is provided a soil spreading scraper device comprising:

a frame supported for movement along the ground in a forward working direction;

a cutting blade supported on the frame so as to be arranged to cut soil from the ground as the frame is displaced in the forward working direction; and an impeller member supported on the frame rearward of the cutting blade for rotation about an impeller axis within a plane of rotation lying generally perpendicularly to the impeller axis, the plane of rotation extending generally upward at an angle from horizontal;

the impeller member comprising a main disc body and a plurality of impeller blades supported on the main disc body at circumferentially spaced apart locations about the impeller axis so as to be arranged to spread cut soil from the cutting blade generally radially outward from the impeller axis as the impeller member is rotated;

a perimeter wall supported on the frame to extend about at least a portion of the circumference of the impeller member to define an impeller chamber within which the impeller member rotates;

a first discharge opening in the perimeter wall extending about a respective first portion of the circumference of the impeller member through which the impeller member is arranged to discharge the cut soil in a first lateral direction;

a second discharge opening in the perimeter wall extending a respective second portion of the circumference of the impeller member through which the impeller member is arranged to discharge the cut soil in a second lateral direction opposite to the first lateral direction;

a gate panel supported on the frame so as to be movable in a circumferential direction of the impeller member between a first position spanning the first discharge opening for discharging through the second discharge opening and a second position spanning the second discharge opening for discharging through the first discharge opening;

a rear support arm extending radially outward from a pivotal connection to the frame at the impeller axis at a location rearward of the impeller member to an outer end of the rear support arm supporting the gate panel thereon;

wherein the rear support arm comprises the only connection between the gate panel and the pivotal connection to the frame at the impeller axis.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
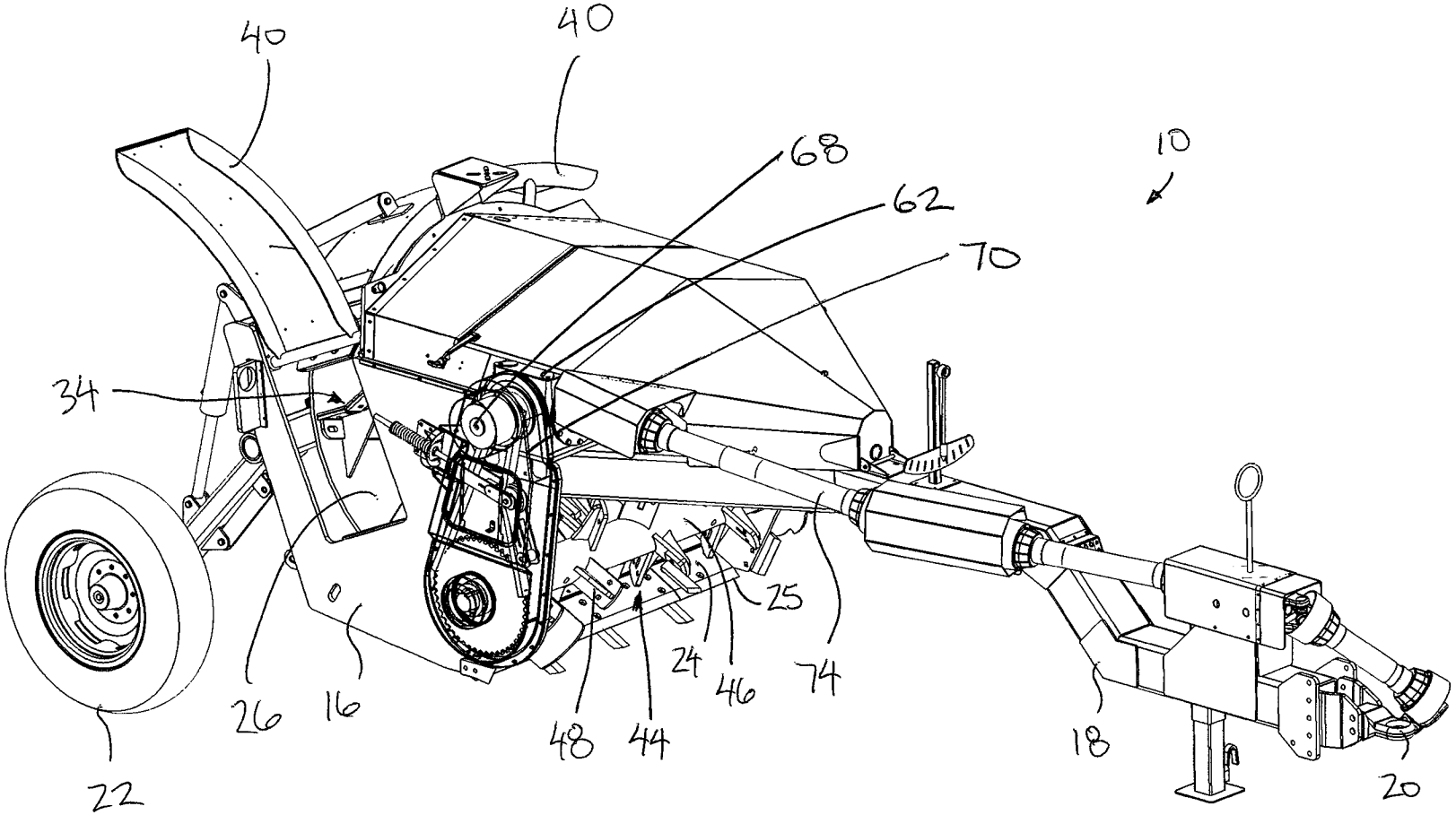
FIG. 1 is a perspective view of the soil spreading scraper device.
Figure 2:
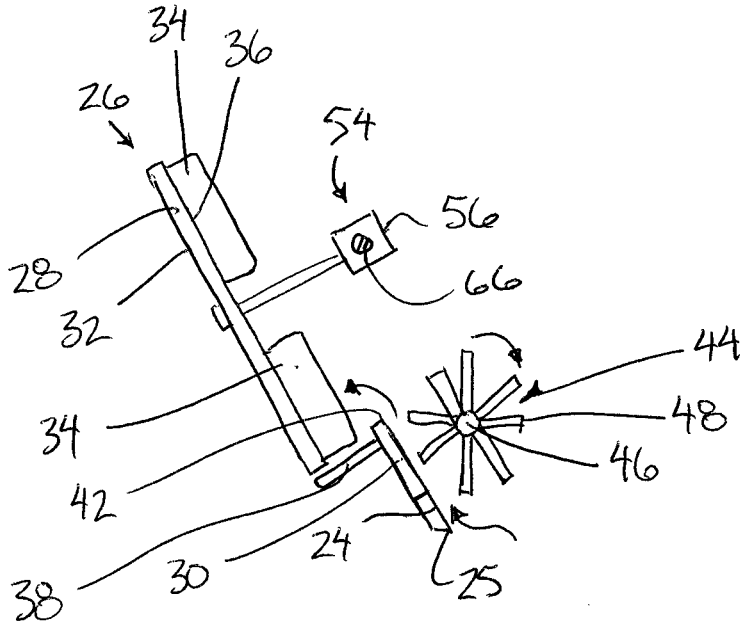
FIG. 2 is schematic side elevational view of the device.

Referring to the accompanying figures there is illustrated a soil spreading scraper device generally indicated by reference numeral 10. The device 10 is particularly suited for cutting a top layer of soil from the ground as the device is advanced in a forward working direction across the ground and for spreading the cut soil laterally outward to one side relative to the forward working direction.

In the illustrated embodiment, the device 10 includes a frame which is suitable for towing by a towing vehicle such as a tractor including a suitable hitch and power takeoff.

The main frame 16 of the device 10 includes a main body from which a hitch arm 18 projects forwardly towards a hitch connector 20 at a forward end thereof suitable for connection to the hitch of the towing vehicle. The main body is supported at a rear end by a pair of wheels 22 which are laterally spaced apart at the rear end of the main body. The wheels 22 are supported for independent height adjustment relative to the main body for adjusting the overall height of the frame, which in turn adjusts the depth of cut of the device into the soil, and for adjusting the inclination of the frame relative to the ground which adjusts an angle of cut of the device into the ground.

The device 10 generally comprises a cutting blade 24 spanning laterally across the frame for cutting the top layer of soil from the ground, an impeller member 26 which spreads the soil cut by the cutting blade 24 and a kicker 44 for propelling the soil cut by the cutting blade 24 onto the impeller member 26 which is rotatable about a horizontal kicker axis.

The cutting blade 24 spans along the front edge of the main body of the frame 16, along the bottom side thereof, to extend downwardly and forwardly to a forward cutting edge 25. The forward cutting edge spans linearly in a lateral direction across a full width of the impeller member, horizontally and perpendicularly to the forward working direction. The body of the cutting blade 24 is generally planar and oriented at an angle from horizontal which is less than the plane of rotation of the impeller member, for example at an angle which is between 15 and 25 degrees from horizontal, and more preferably which is near 20 degrees from horizontal.

A pan 30 extends rearwardly and upwardly from the cutting blade 24 towards the impeller member 26 which is positioned rearwardly of the soil cutting blade 24.

The impeller member 26 generally comprises a disc body 28 in the form of a flat, circular plate of rigid material defining a bottom side 32 of the impeller member which rotates within a rotation plane oriented perpendicularly to an impeller axis about which the impeller member rotates relative to the frame. The impeller member is supported on the frame so that the rotation plane extends at an upward and rearward angle from a location rearward of the cutting blade 24 at an angle of near 75° from the ground in the illustrated embodiment, though a rotation plane generally in the range of 45° to 75° can still be beneficial.

The impeller member includes a plurality of impeller blades 34 which are each supported on the disc body at the bottom side 32 of the impeller member to extend both radially outward from the impeller axis to a periphery of the impeller member and to extend upwardly from the disc at the bottom side 32 generally in the direction of the impeller axis to an open top side 36 of the impeller member when in a normal working position. The blades and the disc at the bottom side 32 of the impeller member rotate together about the impeller axis so as to spread cut soil deposited on the impeller member generally radially outward relative to the impeller axis.

A peripheral wall 38 is provided about a bottom portion of the periphery of the impeller member 26 having a height which spans between the top and bottom sides of the impeller member. An inner surface of the peripheral wall 38 against which the impeller member periphery rotates may comprise a wear member having a low coefficient of friction, for example a plastic line. The wear member is mounted on the peripheral wall for ready separation and replacement thereof to maintain the wear member in optimal low friction condition. Periodic replacement of the wear member reduces friction of soil being spread by the impeller member as it is rotated along the inner surface of the peripheral wall 38 and thus minimizes friction against rotation of the impeller member.

An upper portion of the periphery about the impeller member openly communicates with discharge chutes 40 curving upwardly and laterally outward so that the material thrown radially outward by the impeller member is thrown onto the chutes 40 and redirected generally laterally outward in a sideways direction which is generally perpendicular to the forward working direction.

More particularly, the perimeter wall 38 is a generally cylindrical about which is supported on the frame to extend about at least a portion of the circumference of the impeller member to define the impeller chamber within which the impeller member rotates. A first discharge opening 100 is provided in the perimeter wall extending about a respective first portion of the circumference of the impeller member through which the impeller member is arranged to discharge the cut soil in a first lateral direction using a first one of the chutes that communicates with the first discharge opening. Similarly, a second discharge opening 102 is provided in the perimeter wall extending a respective second portion of the circumference of the impeller member through which the impeller member is arranged to discharge the cut soil in a second lateral direction opposite to the first lateral direction using a second one of the chutes that communicates with the second discharge opening.

A gate panel 104 is supported on the frame so as to be movable in a circumferential direction of the impeller member between a first position spanning the first discharge opening for discharging through the second discharge opening and a second position spanning the second discharge opening for discharging through the first discharge opening. The gate panel 104 has the shape of a portion of a cylinder so as to be curved about the impeller axis and so as to generally follow the curvature of the perimeter wall 38. The gate panel spans the full depth of the chamber in the direction of the impeller axis similarly to the perimeter wall.

A rear support arm 106 provides support to the gate panel. The rear support arm 106 extends radially outward from a pivotal connection 108 to the frame at the impeller axis at a location rearward of the impeller member. The rear support arm is a single, unitary, seamless body of material between the inner end of the arm at the pivotal connection and the outer end of the rear support arm which supports the gate panel thereon.

The rear support arm is connected to the rear edge of the gate panel at a central location thereon. Gussets provide additional support at the connection between the rear support arm and the gate panel. The opposing front edge of the gate panel remains a free unsupported edge such that the rear support arm comprises the only connection between the gate panel and the pivotal connection 108.

A hydraulic linear actuator 110 is coupled between the frame and an intermediate location on the rear support arm spaced from the impeller axis for displacing the gate panel between first and second positions as the actuator is extended and retracted.

The pan 30 terminates at a rear edge 42 which is semicircular about a centre at the impeller axis so that the edge 42 follows the shape of the peripheral wall 38 about a periphery of the impeller member 26.

The kicker 44 is supported for rotation on the frame about a respective kicker axis which extends generally horizontally, transversely and perpendicularly to the forward working direction, at a location which is spaced above and forward of the front edge of the cutting blade 24, while also being located forwardly of the impeller member, bellow the impeller axis.

The kicker 44 includes a shaft 46 extending along the kicker axis and arranged for supporting a plurality of kicker blades 48 extending generally radially outward therefrom. The plurality of kicker blades 48 are provided at circumferentially and axially spaced positions relative to one another with suitable dimensions to rotate in close proximity to the pan so that any soil cut by the cutting blade and lifted onto the pan is engaged by the kicker blades 48 which rotate rearwardly at a bottom side thereof to propel the cut soil rearwardly onto the impeller member.

The kicker blades 48 each comprise a planar paddle member oriented to project or propel the cut soil laterally inward towards a center of the kicker as it is thrown rearward onto the impeller member. More particularly, each planar paddle is oriented so as to be approximately 45 degrees in inclination relative to a first plane that is perpendicular to the axis of rotation, and a second plane that includes the axis of rotation therein. Due to the pan being terminated at a rearward edge at the front side of the impeller member and the high angle of elevational of the impeller member relative to the ground, the material thrown rearward by the kicker is projected onto a very large portion of the surface of the impeller member to encourage capturing a maximum volume of soil to be subsequently spread by the impeller member. The combination of the high angle impeller member and low rear edge of the pan further promotes rotation of the impeller member at higher revolutions per minute (RPM) as compared to prior art configurations.

An impeller drive 54 is provided for receiving a driving rotation from a drive source comprising the power takeoff 14 of the towing vehicle. The impeller drive comprises an impeller gearbox 56 having an input shaft oriented generally horizontally and perpendicular to the forward working direction, and an output shaft which is geared to rotate with the input shaft rotation at a prescribed ratio and which is directly coupled to the impeller member at the axis thereof. The output shaft is parallel and coaxial with the impeller axis so that the output shaft of the impeller gearbox 56 and the impeller member can be directly coupled to one another in fixed relative orientation without any variable angle connectors therebetween.

The input shaft of the impeller gearbox 56 receives the driving rotation from the drive source through an auxiliary gearbox 62 having an input shaft oriented in the forward working direction and projecting forwardly towards the power takeoff of the towing vehicle. The auxiliary gearbox 62 is laterally offset in relation to the forward working direction from the impeller gearbox 56 so that a first output shaft 66 of the auxiliary gearbox is parallel and coaxial with the input shaft 58 of the impeller gearbox with which it is directly coupled so that the first output shaft 66 is also oriented generally horizontally and perpendicular to the forward working direction.

The auxiliary gearbox also includes an opposing second output shaft 68 extending horizontally outward in the opposing direction relative to the first output shaft 66 so that the two output shafts are generally concentric with one another. The second output shaft 68 is coupled via a drive chain 70 to one end of the shaft of the kicker 44 so as to define a kicker drive which drives the rotation of the kicker about its respective kicker axis from the driving rotation provided by the power takeoff 14 of the driving vehicle.

A drive shaft 74 is provided for coupling between the input shaft of the auxiliary gearbox 62 and the power takeoff of the tractor. The drive shaft 74 is provided with a multiple variable angle connectors in series to provide connection from the input shaft of the auxiliary gearbox to the power takeoff of the towing vehicle.

In the configuration described, the towing vehicle produces a driving rotation which is transferred from the power takeoff of the vehicle through the drive shaft 74, to the auxiliary gearbox 62 which in turn drives the impeller member through the impeller gearbox 56 and the kicker 44 through the drive chain 70.

In the event of debris being lodged between the kicker and the cutting blade or the pan 30, a reverser assembly (not shown) is used to force a reverse rotation of the kicker about the kicker axis to dislodge the debris.

Turning now to FIGS. 4 through 21, various embodiments of each of the impeller blades 34 supported on the main disc body 28 will now be described in further detail. The common features of the various embodiments will first be described.

Figure 3:
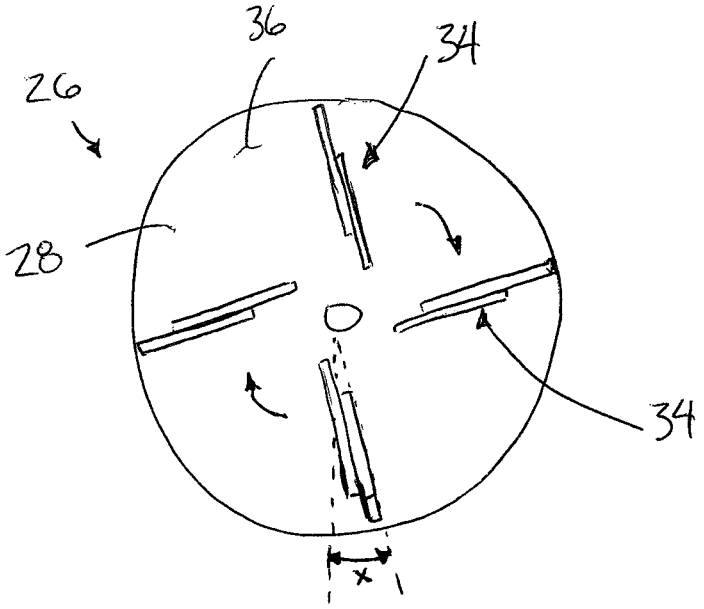
FIG. 3 is a schematic front view of the impeller disc of the device.

In each instance, each impeller blade includes a base plate 200 arranged to be fastened to the main disc body in a flat parallel arrangement directly against an upper top side of the main disc body which faces forwardly in the forward working direction. The plate is generally elongate in the radial direction to span between opposing inner and outer ends. Respective bolt apertures 202 are provided at each of the opposed ends for fastening at radially spaced positions to the main disc body. Each blade assembly 34 includes a pivot shaft 204 which is supported at spaced apart positions by a pair of support plates 206. The two support plates are spaced apart in the axial direction of the pivot shaft 204 to extend perpendicularly upward from the base plate 200 in the direction of the impeller axis. The pivot shaft 204 is fixed relative to the two support plates 206 such that the pivot shaft extends generally in a radial direction relative to the impeller body. More particularly as shown in FIG. 3, the shaft axis of the pivot shaft is angularly offset by an acute angle 'x' for example in the range 0 to 30 degrees from a radial axis extending from the impeller axis. The pivot shaft 204 lies generally within a plane which is parallel to the disc body and perpendicular to the impeller axis.

A pivot tube 208 is rotatably supported about the pivot shaft 204 adjacent the outer end thereof for free pivotal movement about the shaft. A plate like blade body 210 is fixed along on the inner bottom edge to the pivot tube 208 so as to be pivotal together with the pivot tube together with the pivot tube about the respective pivot shaft. The blade body comprises a lower portion adjacent the pivot tube and an upper portion supported at the outer end of the lower portion farthest from the pivot tube such that in a working position, the tube plate members lie generally transversely to the circumferential direction of rotation at an obtuse angle relative to one another such that the leading face of the blade body 210 is generally concave and cup-shaped for scooping cut soil for subsequent throwing of the soil through one of the discharge openings.

The pivot tube permits each blade body to be pivotal about the respective shaft axis of the respective pivot shaft between a working position in which the blade body extends primarily away from the pivot shaft in the direction of the impeller axis away from the main disc body and a deflected position in which the blade body extends generally along the top side of the main disc body so as to extend from the pivot shaft in a circumferential direction in a trailing relationship relative to the pivot shaft.

An actuating assembly 212 is provided for supporting the blade body in the working position and resisting displacement of the blade body from the working position towards the deflected position until a pressure on the paddle at the leading side exceeds a prescribed holding force of the actuating assembly. More particularly when the leading face of the blade body encounters debris, such as a rock resulting in an impact force which generates sufficient moment about the pivot shaft to overcome the holding force of the actuating assembly, the actuating assembly is released and the blade body is displaced towards the deflected position.

Turning now more particularly to the embodiment in FIGS. 4 through 11, the pivot tube 208 in this instance comprises a first cam element having a first helical camming surface 214 formed at the inner end thereof. A second cam element 216 is provided as a second tube received about the pivot shaft at the inner end of the first cam element. The second cam element includes a second helical cam surface 218 at the outer end thereof which has a matching helical angle with the first helical cam surface with which it is abutted.

A spring 220 is provided which is helically wound about the pivot shaft inward of the second cam element 216. The second cam element 216 includes a key 222 extending in the axial direction along one side thereon for sliding cooperation relative to a corresponding groove in one of the support plates 206. The key ensures that the second cam element can only be displaced by axial sliding relative to the pivot shaft which effectively compresses the spring 220 abutted against the inner side of the second cam element. In this arrangement, pivoting of blade body causes the corresponding pivot tube with the first helical cam surface 214 thereon to be rotated about the pivot shaft, which in turn interacts with the second helical cam surface by relative sliding engagement therebetween to displace the second cam element axially inward towards the impeller axis to compress the spring 220 at the inner end of the pivot shaft. The spring is arranged to provide a biasing to return the blade body from the deflected position to the working position throughout the full range of movement of the blade body.

A suitable tubular cover is preferably provided about the spring at the inner end of the pivot shaft for protecting the spring from debris as in other embodiments.

Figure 4:
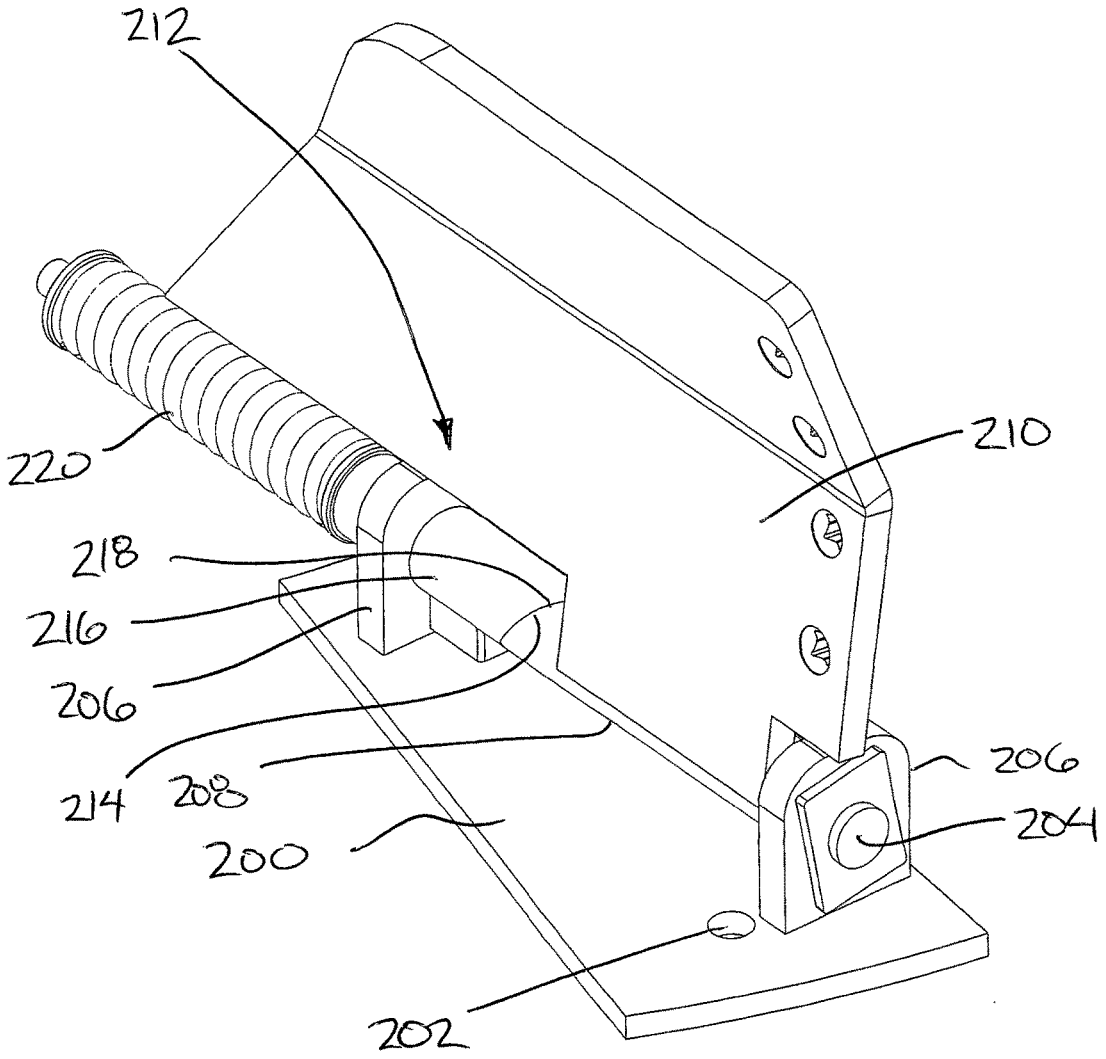
FIG. 4 is a perspective view of one of the impeller blades of the device in a working position according to a first embodiment.
Figure 5:
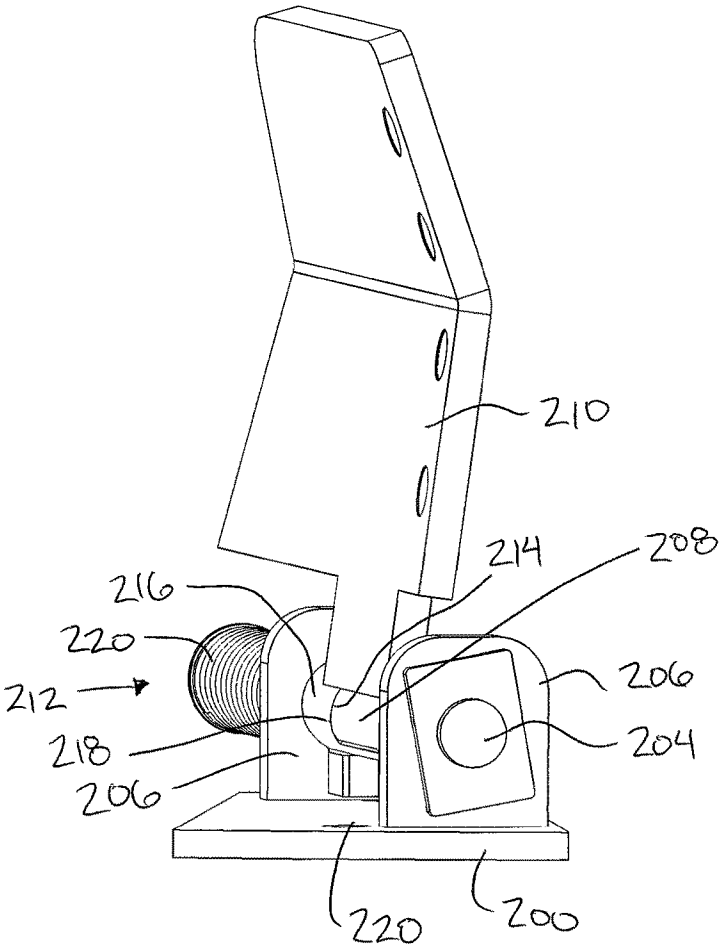
FIG. 5, FIG. 6, and FIG. 7 are end elevational, front elevational and top plan views of the impeller blade according to the first embodiment of FIG. 4 in the working position.
Figure 6:
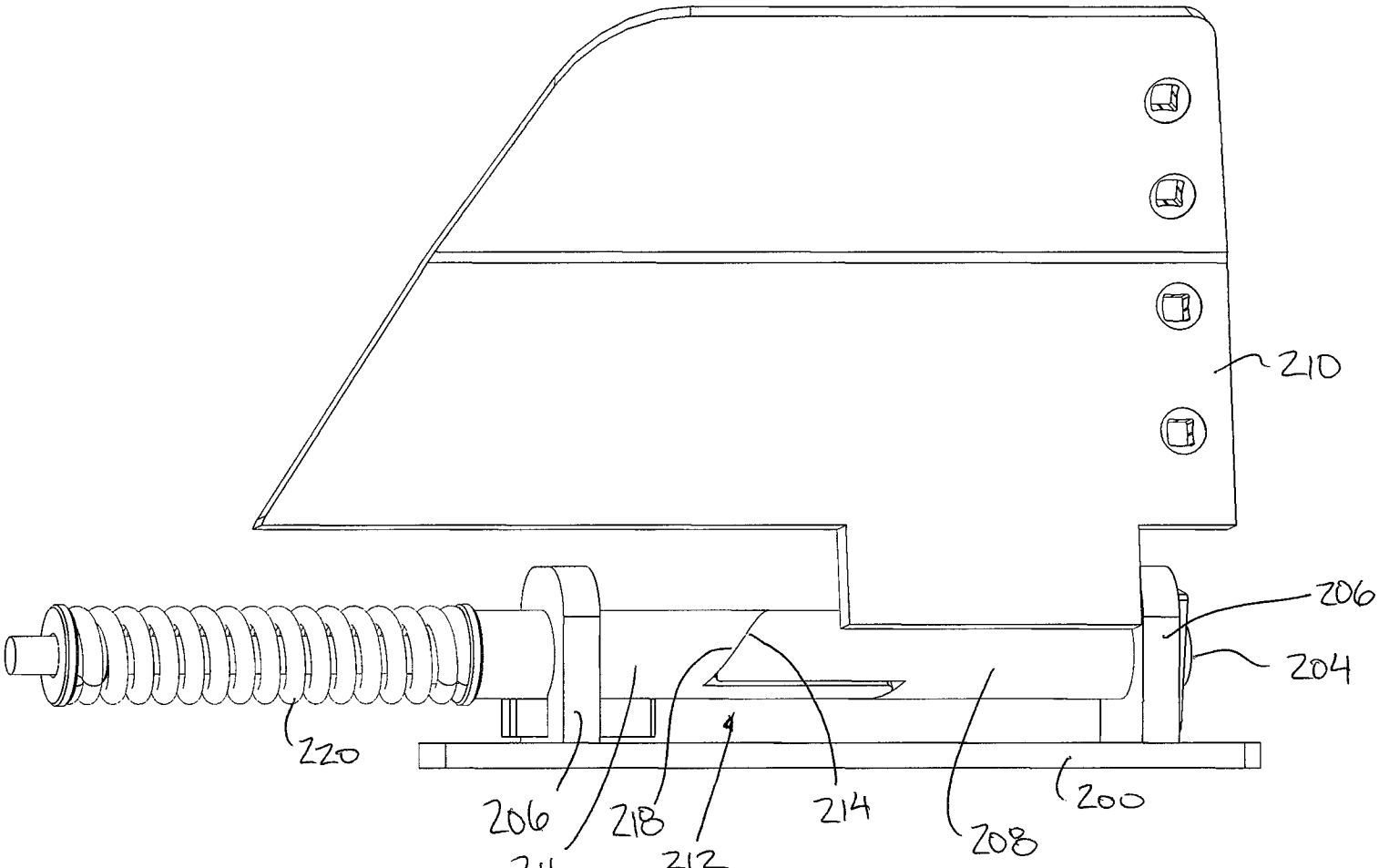
Figure 7:
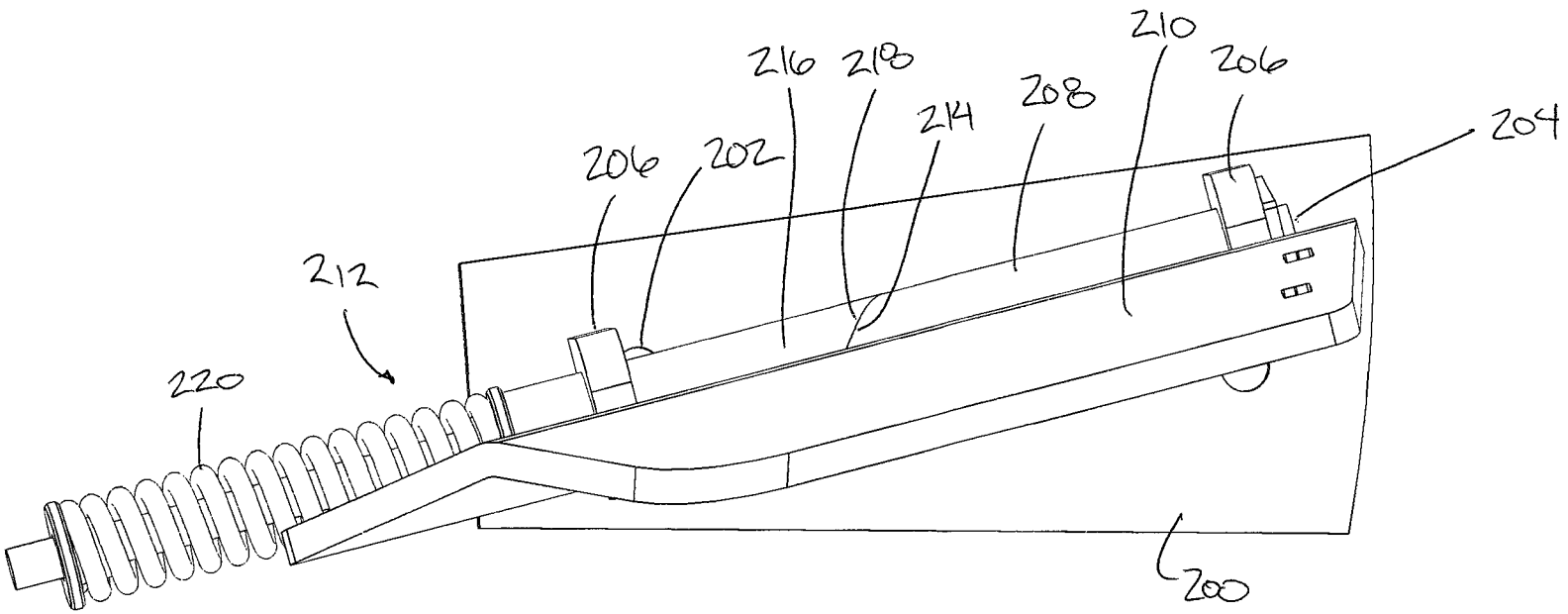
Figure 8:
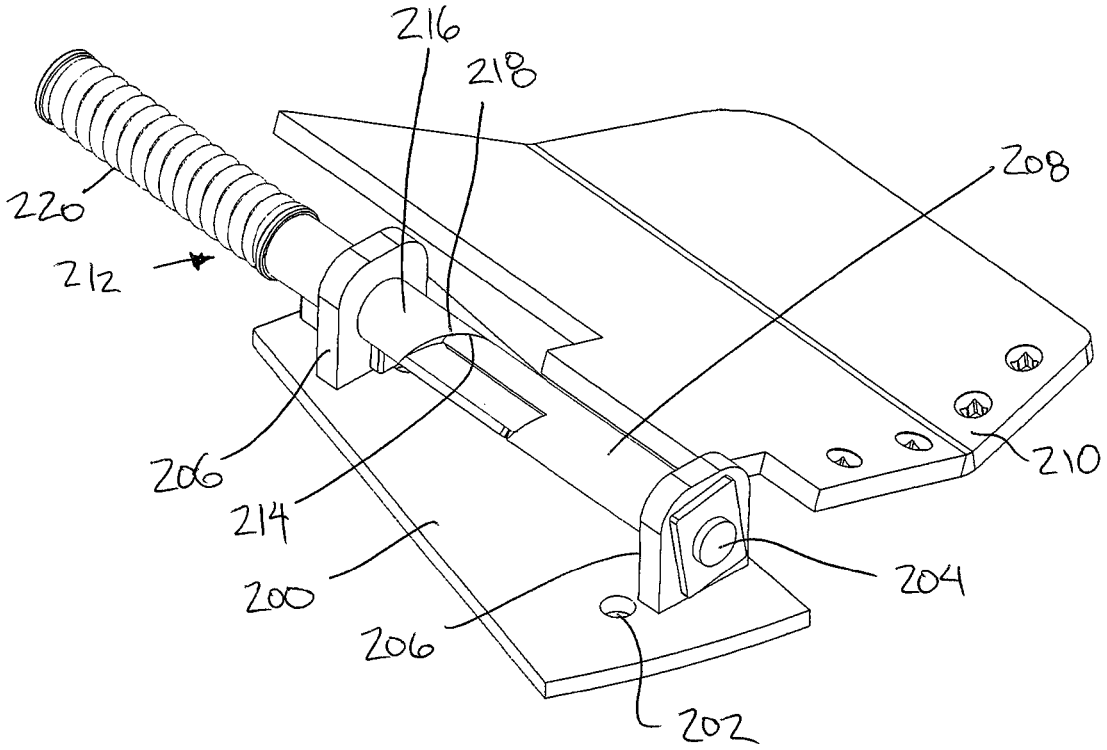
FIG. 8 is a perspective view of one of the impeller blades of the device in a deflected position according to the first embodiment of FIG. 4.
Figure 9:
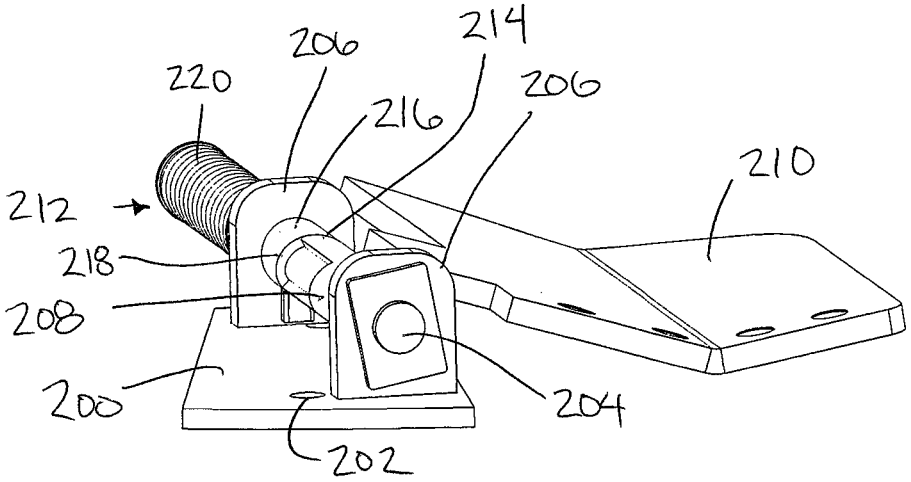
FIG. 9, FIG. 10, and FIG. 11 are end elevational, top plan, and front elevational views of the impeller blade according to FIG. 8 in the deflected position.
Figure 10:
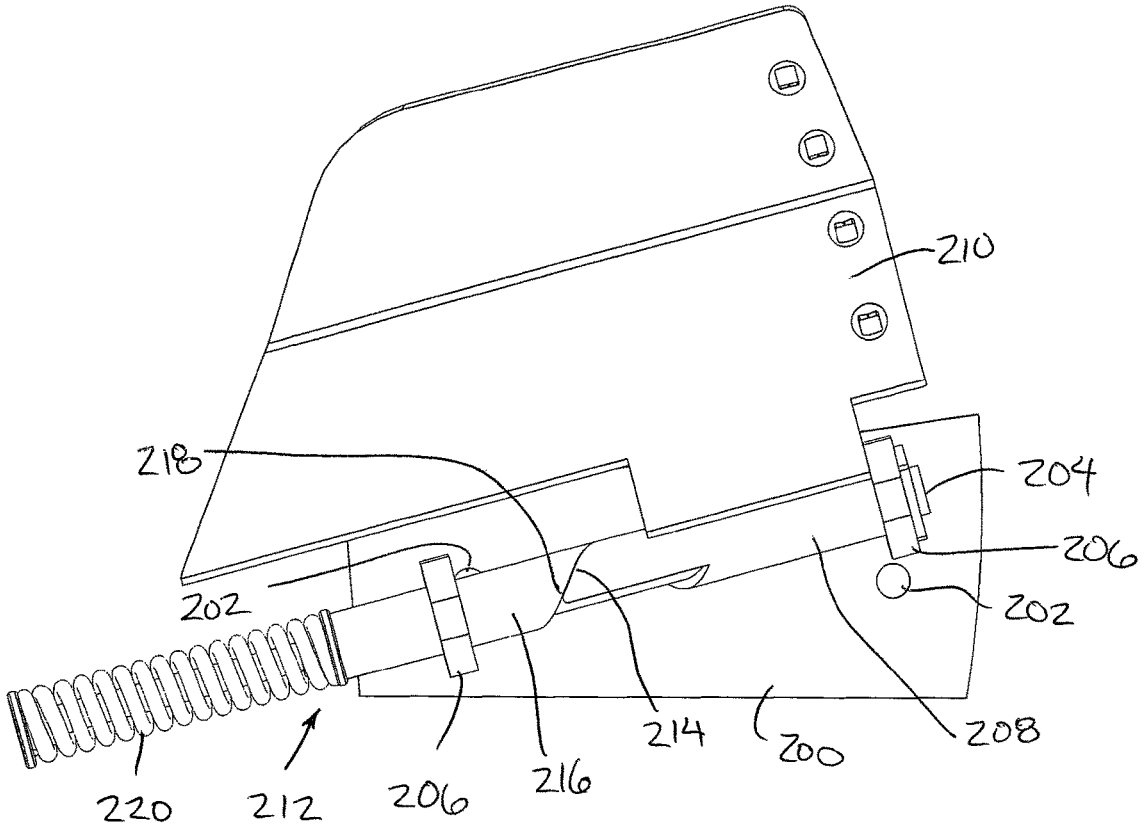
Figure 11:
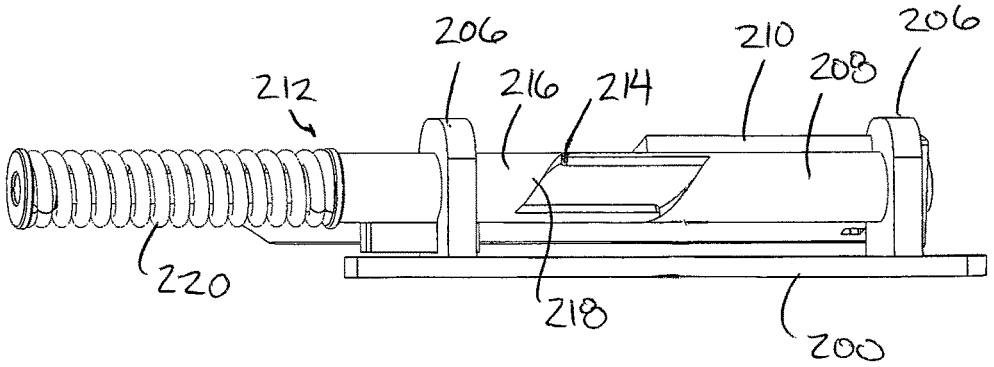
Figure 12:
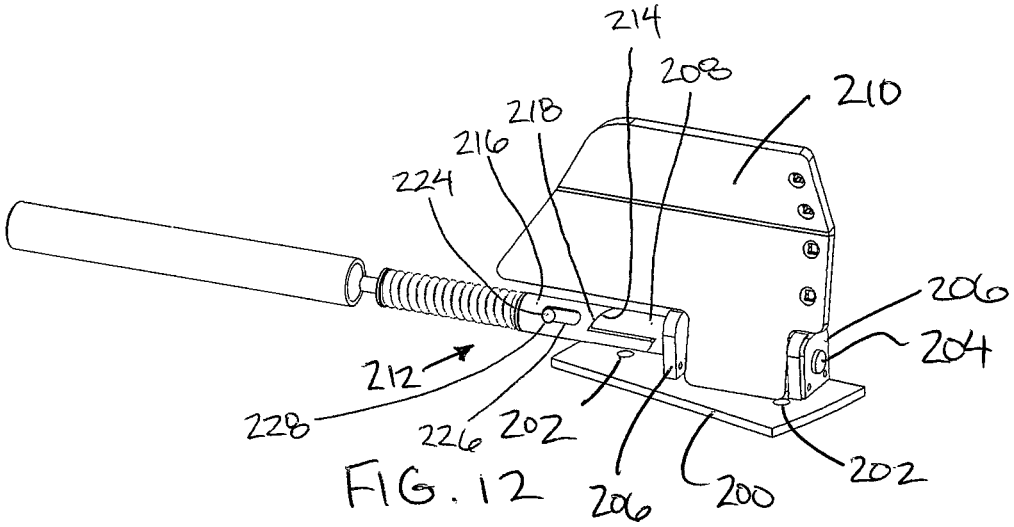
FIG. 12 and FIG. 13 are perspective views of a second embodiment of the impeller blade in the working position.
Figure 13:
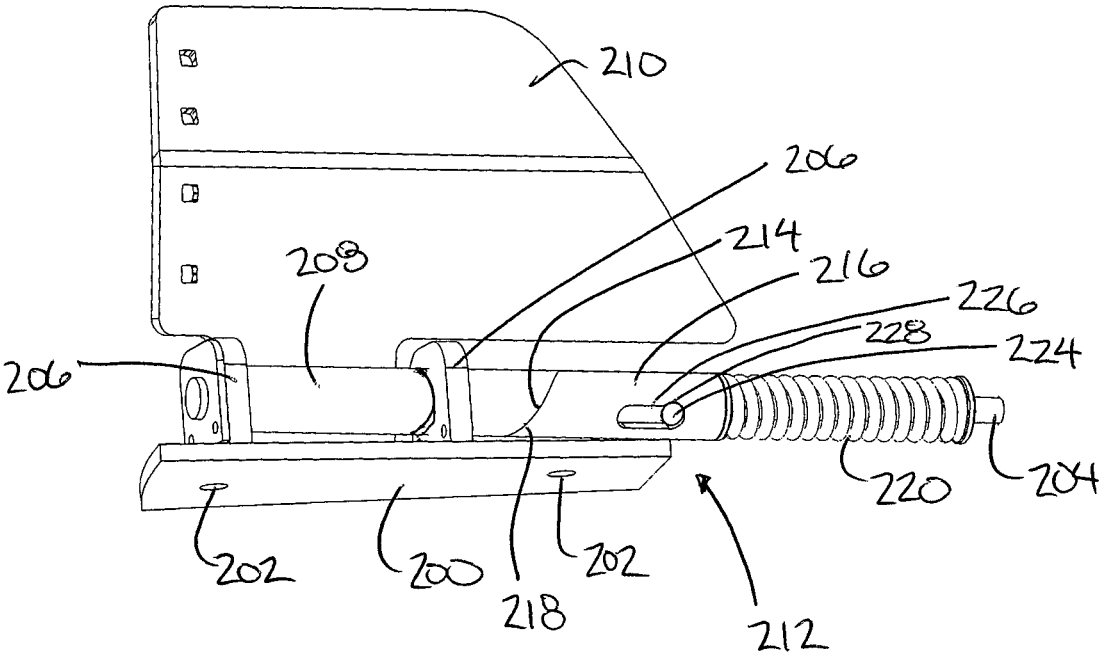
Figure 16:
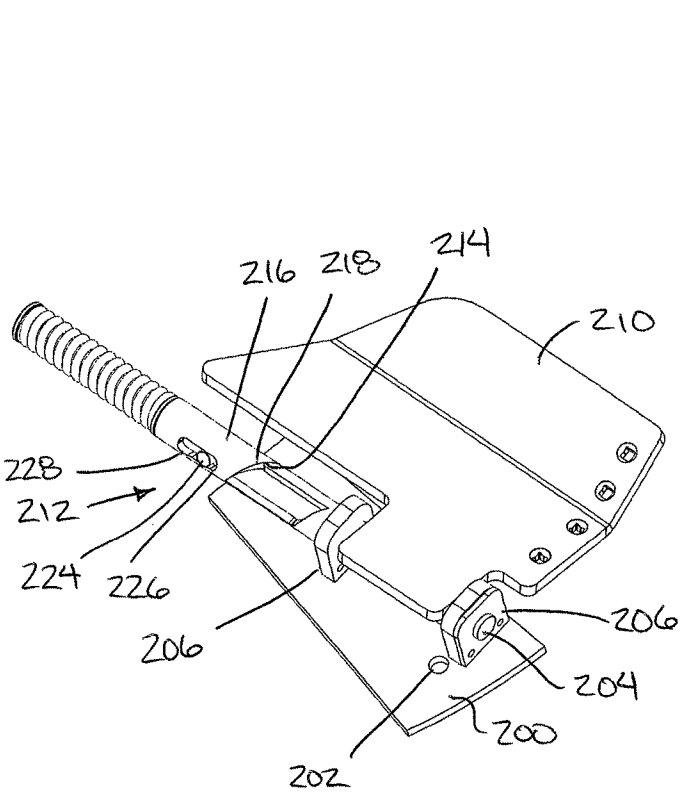
FIG. 16 is a perspective view of the impeller blade according to the second embodiment of FIG. 12 in the deflected position.
Figure 14:
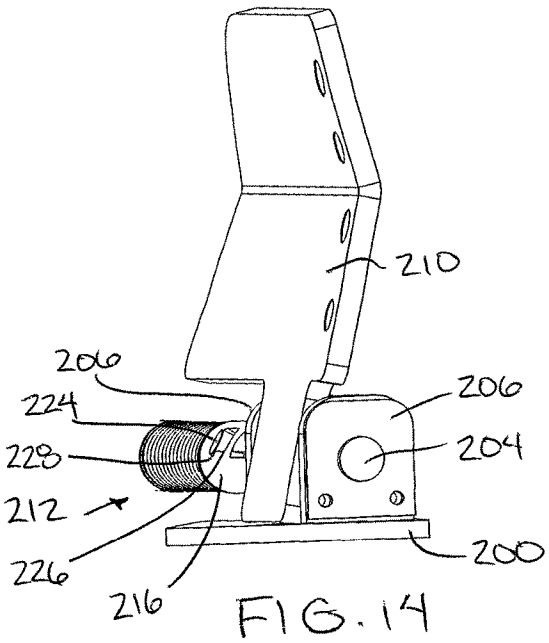
FIG. 14 is an end view of the impeller blade according to the second embodiment of FIG. 12 in the working position.
Figure 15:
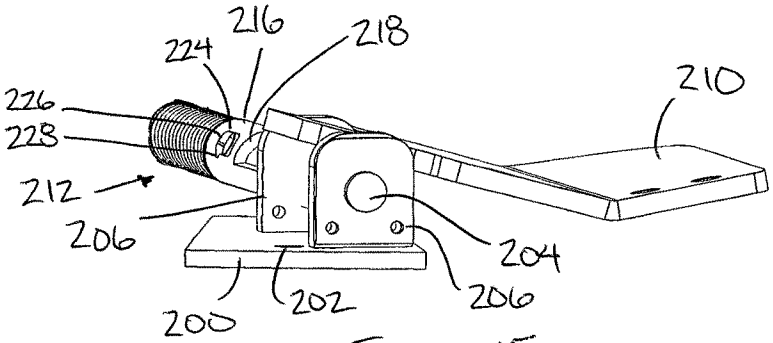
FIG. 15 is an end view of the impeller blade according to the second embodiment of FIG. 12 in the deflected position.
Figure 17:
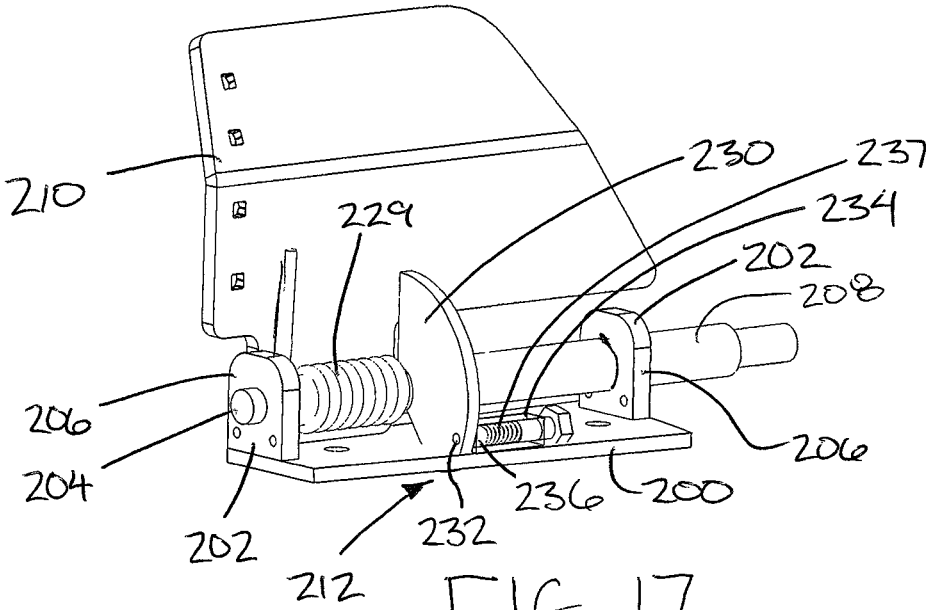
FIG. 17 and FIG. 18 are perspective views of a third embodiment of the impeller blade in the working position.
Figure 18:
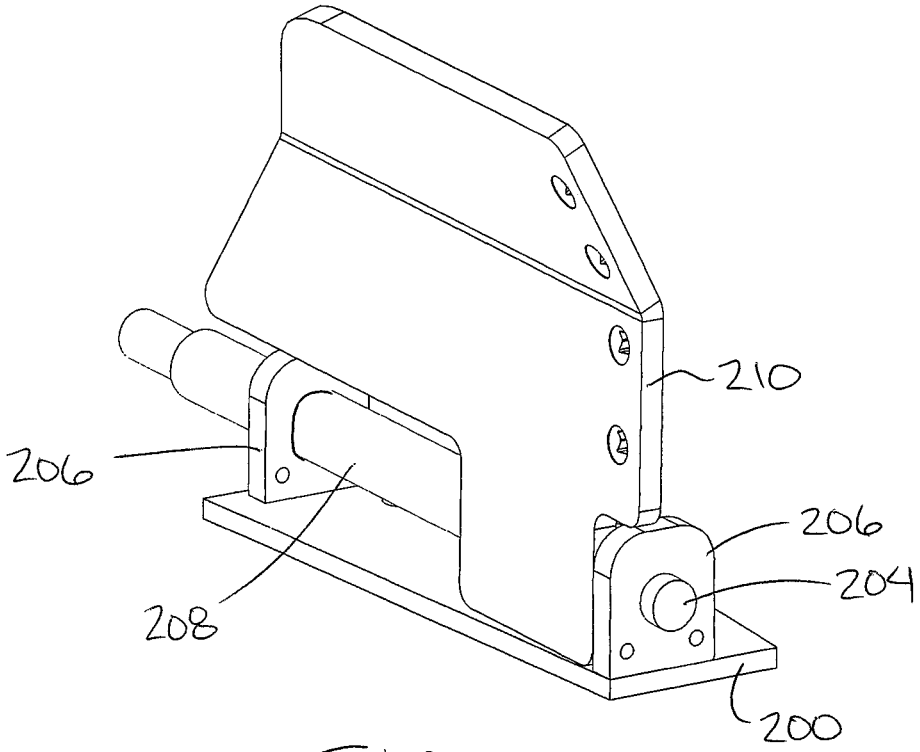
Figure 21:
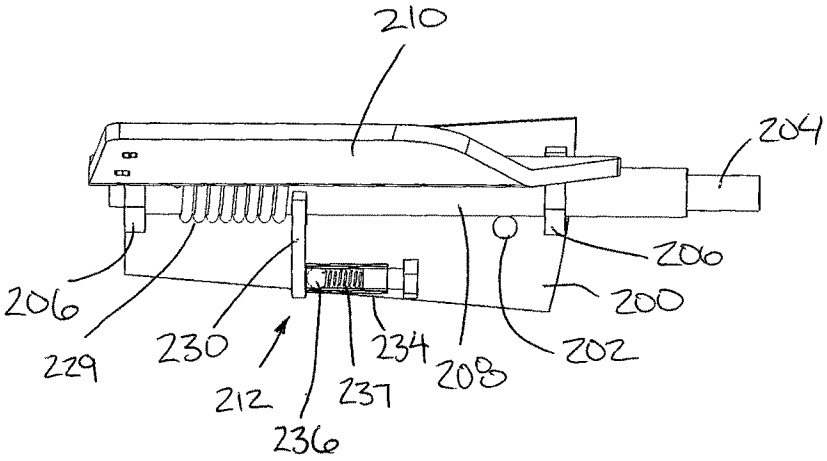
FIG. 21 is a top view of the impeller blade according to the third embodiment of FIG. 17, shown in the working position.
Figure 19:
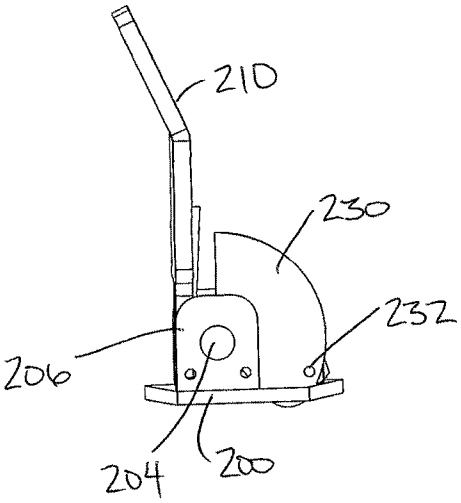
FIG. 19 and FIG. 20 are end views of the impeller blade according to the third embodiment of FIG. 17, shown in the working position and the deflected position respectively.
Figure 20:
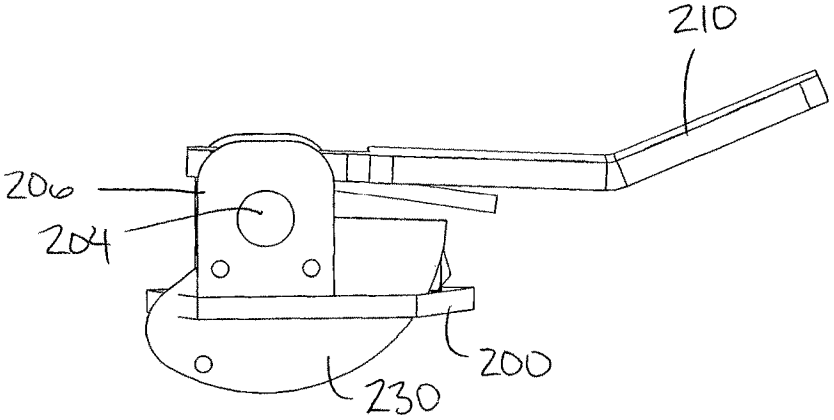
Figure 22:
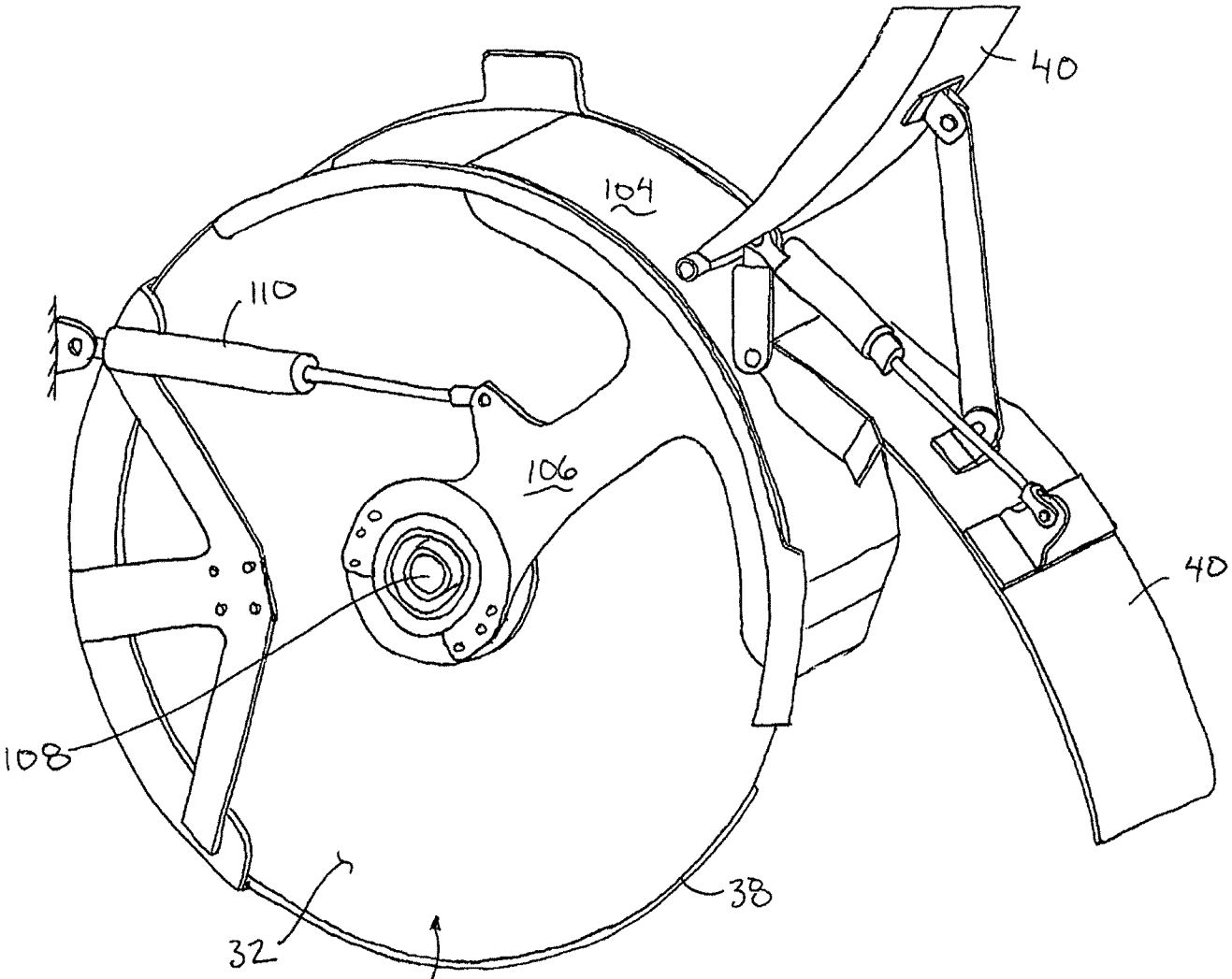
FIG. 22 is a perspective view of the discharge gate of the soil spreading scraper device according to the FIG. 1.
Figure 23:
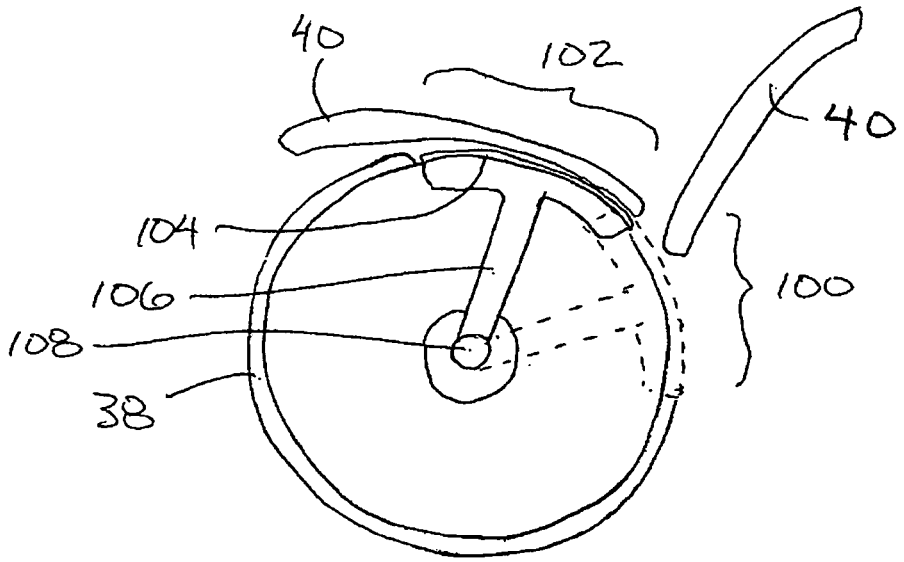
FIG. 23 is a schematic rear view of the discharge gate according to FIG. 22.
Figure 24:
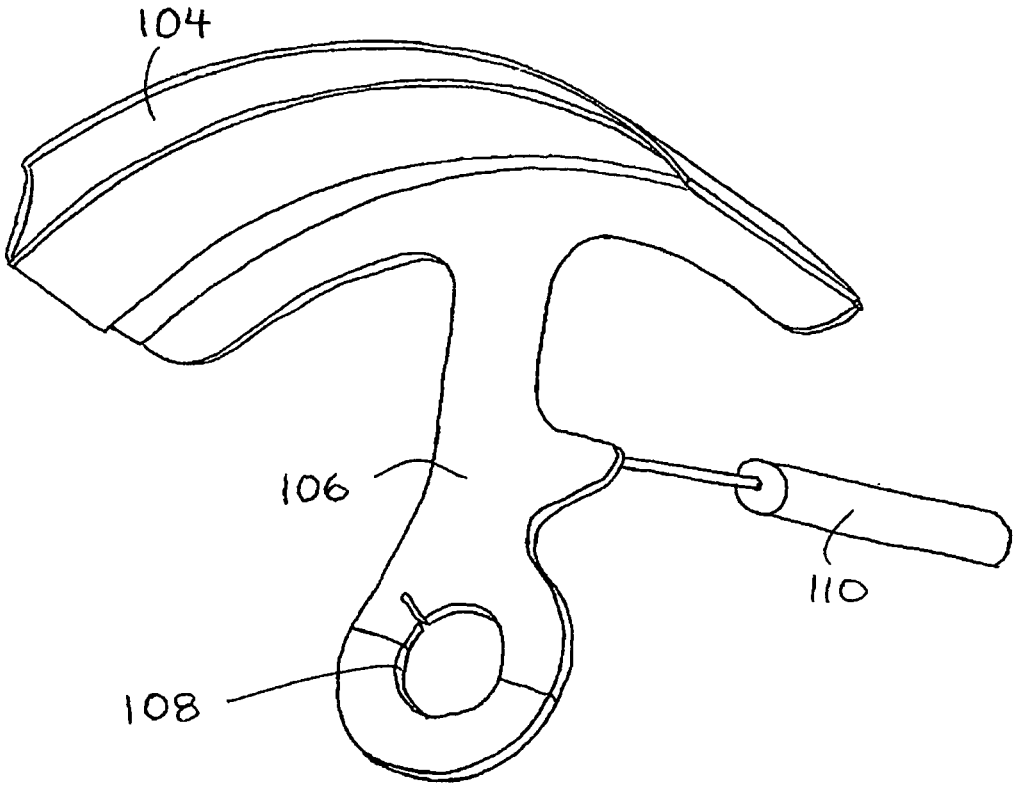
FIG. 24 is a perspective view of the discharge gate shown separated from the device.

According to a variant of the first embodiment shown in FIG. 4, the helical cam surfaces 214 and 218 may be shaped to instead have a helical surface with a non-constant slope such that the resulting axial sliding of the second cam element is in a non-linear relationship with the rotation of the first cam element about the pivot shaft. Furthermore, the cam surfaces may be provided with a corresponding notch and protrusion which mate with one another in the working position to define the holding force which is greater than a subsequent resistive force once the protrusion is dislodged from the socket throughout continued displacement of the blade body from the working position to the deflected position. In this instance, the spring acting on the remaining cam surfaces provides a resistive force throughout the range of pivotal movement of the blade body which is less than the initial prescribed holding force of the actuating assembly provided by the interlocking protrusion and socket formed in the mating cam surfaces.

Turning now to the embodiment in FIGS. 12 through 16, the first cam element 208 and the second cam element 216 may be again arranged similarly to the previous embodiment with the exception of the second cam element no longer being keyed for linear sliding. In this instance, a pair of guide pins 224 are fixed at diametrically opposed locations at the pivot shaft so as to be also fixed relative to the base plate and main disc body of the impeller. Two slots 226 are provided at the second cam element at diametrically opposed locations for receiving the two pins 224 therein respectively. Each slot extends primarily in the axial direction such that most of the movement between the working position and the deflected position corresponds to a linear sliding of the second cam element in linear proportion to the rotation of the first cam element. The innermost end of each slot however includes an offset portion 228 where the slot has an extent extending generally in the circumferential direction which receives the pin therein in the working position. In this manner, prior to providing a linear resistive force throughout most of the range of pivotal movement of the blade body, a much greater prescribed holding force must be overcome to cause the pin to be dislodged from the respective circumferential extent of each slot 226 to cause some slight pivotal movement of the second cam element about the pivot shaft prior to allowing subsequent linear sliding thereof.

Turning now to the embodiment of FIGS. 17 through 21, in this instance, a torsion spring may be supported by helically winding about the pivot shaft in cooperative connection between the blade body and the base portion 200 to directly bias the blade body from the deflected position back towards the working position throughout the full range of movement thereof.

The actuating assembly in this instance includes a pivot plate 230 fixed to the trailing side of the blade body so as to be perpendicular to the shaft axis and so as to be pivotal with the blade body relative to the base plate 200. A socket 232 is formed in the pivot plate to be recessed in the direction of the shaft axis into a surface of the pivot plate which is perpendicular to the shaft axis.

The base plate in this instance supports a pin holder 234 thereon in which a tubular opening within the holder 234 receives a pin 236 therein such that the pin is slidable in the axial direction of the shaft axis between an engaged position at least partially received within the socket 232 of the plate, and a disengaged position fully removed from the socket. A spring 237 is provided within the passage in the holder 234 to bias the spring into engagement within the socket 232. Typically the pin comprises a ball having a concave outermost surface received within the socket 232. The pin 236 is aligned for insertion into the socket in the engaged position when the blade body is in the working position. In this manner, sufficient initial force must be applied to the leading face of the blade body to force the pin 236 to be displaced out of the socket from the engaged position to the disengaged position against the force of the spring 237 to initially release the blade from the working position. Once the pin is removed from the socket 232, the ball simply rides along the surface of the pivot plate 230 locating the socket therein such that a much smaller resistive force is required to continue to pivot the plate body from the working position towards the deflected position once the pin is in the disengaged position. When force on the leading face of the blade body has passed, the torsion spring 229 about the pivot shaft serves to return the blade body back to the working position where the spring 237 returns the pin member 236 into the engaged position.

According to a further variant of the actuating assembly, the pin member 236 and corresponding spring 237 may be replaced with a shear bolt which is connected in the axial direction of the shaft accessed from the holder body 234 to the pivot plate 230 to retain the blade body in the working position until sufficient pressure is applied to the face of the blade body to cleanly shear the bolt. In this instance, no additional biasing spring is necessary as the blade body can remain folded in the deflected position until manually reset by a user together with replacement of the broken sheared bolt.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A soil spreading scraper device comprising:

a frame supported for movement along the ground in a forward working direction;

a cutting blade supported on the frame so as to be arranged to cut soil from the ground as the frame is displaced in the forward working direction; and an impeller member supported on the frame rearward of the cutting blade for rotation about an impeller axis within a plane of rotation lying generally perpendicularly to the impeller axis, the plane of rotation extending generally upward at an angle from horizontal;

the impeller member comprising a main disc body and a plurality of impeller blades supported on the main disc body at circumferentially spaced apart locations about the impeller axis so as to be arranged to spread cut soil from the cutting blade generally radially outward from the impeller axis as the impeller member is rotated;

each impeller blade comprising:

a pivot shaft supported on the main disc body;

a blade body supported on the pivot shaft so as to be pivotal about a shaft axis of the pivot shaft between a working position in which the blade body extends from the pivot shaft in a direction of the impeller axis away from the main disc body and a deflected position in which the blade body extends from the pivot shaft in a circumferential direction of the disc body in a trailing relationship relative to the pivot shaft; and an actuating assembly which supports the blade body in the working position;

the actuating assembly being adapted to resist displacement of the blade body from the working position to the deflected position until pressure on the paddle exceeds a prescribed holding force of the actuating assembly and release the blade body to allow displacement of the blade body from the working position to the deflected position in response to pressure on the paddle exceeding the prescribed holding force of the actuating assembly.

2. The device according to claim 1 wherein the shaft axis of each impeller blade is oriented primarily in a radial direction relative to the main disc body.

3. The device according to claim 1 wherein the shaft axis of each impeller blade is oriented at an acute angle relative to a radial axis of the main disc body, within a plane lying perpendicular to the impeller axis.

4. The device according to claim 1 wherein each actuating assembly is arranged to apply a resistive force throughout a range of pivotal movement of the respective blade body between the working position and the deflected position in which the prescribed holding force of the actuating assembly in the working position is greater than the resistive force at an intermediate position between the working position and the deflected position.

5. The device according to claim 1 wherein each actuating assembly comprises a spring.

6. The device according to claim 5 wherein the spring is arranged to bias the respective blade body from the deflected position towards the working position throughout a full range of motion of the blade body.

7. The device according to claim 1 wherein each actuating assembly comprises a spring extending helically about the shaft axis, a first cam element supported pivotal movement with the blade body about the shaft axis and a second cam element supported for sliding movement in an axial direction along the shaft axis relative to main disc body in operative connection to the spring, and wherein at least one of the first cam element and the second cam element of each actuating assembly comprises a helical cam surface in sliding contact with the other cam element so as to be arranged to compress the spring as the blade body is pivoted from the working position to the deflected position.

8. The device according to claim 7 wherein both the first cam element and the second cam element comprise a helical cam surface having matching helical angles.

9. The device according to claim 7 wherein the second cam element is guided to rotate about the shaft axis as the second cam element is slidably displaced in the axial direction in a non-linear relationship.

10. The device according to claim 9 wherein each actuating assembly further comprises a pin supported on the pivot shaft in fixed relation to the main disc body and a slot on the second cam element which mates with the pin and dictates rotation of the second cam element about the shaft axis in relation to sliding movement in the axial direction.

11. The device according to claim 1 wherein each impeller blade further includes a base portion supported in fixed relation to the main disc body upon which the blade body is pivotally supported and wherein the actuating element comprises:

a socket supported in fixed relation to one of the blade body and the base portion; and a pin member supported on another one of the blade body and the base portion so as to be slidable in a direction of the shaft axis between an engaged position received within the socket within the working position of the blade body so as to resist displacement of the blade body from the working position and a disengaged position in which the pin member is removed from the socket and does not substantially resist displacement of the blade body between the working position and the deflected position.

12. The device according to claim 11 wherein the pin member of each actuating assembly is spring biased towards the engaged position.

13. The device according to claim 11 wherein the pin member comprises a convex surface arranged to be engaged within the socket.

14. The device according to claim 1 wherein each impeller blade further comprises a base portion supported in fixed relation to the main disc body upon which the blade body is pivotally supported and wherein the actuating element comprises a shear pin connected between the blade body and the base portion so as to be oriented in a direction of the shaft axis.

15. A soil spreading scraper device comprising:

a frame supported for movement along the ground in a forward working direction;

a cutting blade supported on the frame so as to be arranged to cut soil from the ground as the frame is displaced in the forward working direction; and an impeller member supported on the frame rearward of the cutting blade for rotation about an impeller axis within a plane of rotation lying generally perpendicularly to the impeller axis, the plane of rotation extending generally upward at an angle from horizontal;

the impeller member comprising a main disc body and a plurality of impeller blades supported on the main disc body at circumferentially spaced apart locations about the impeller axis so as to be arranged to spread cut soil from the cutting blade generally radially outward from the impeller axis as the impeller member is rotated;

each impeller blade comprising:

a pivot shaft supported on the main disc body;

a blade body supported on the pivot shaft so as to be pivotal about a shaft axis of the pivot shaft between a working position in which the blade body extends from the pivot shaft in a direction of the impeller axis away from the main disc body such that the blade body is operative to spread the cut soil and a deflected position in which the blade body extends from the pivot shaft in a circumferential direction of the disc body in a trailing relationship relative to the pivot shaft such that the blade body is deflected about the shaft axis relative to the working position; and an actuating assembly which supports the blade body in the working position and resists displacement of the blade body from the working position to the deflected position until pressure on the paddle exceeds a prescribed holding force of the actuating assembly;

the actuating assembly comprising a spring which is arranged to bias the respective blade body from the deflected position towards the working position throughout a full range of motion of the blade body.

16. The device according to claim 15 wherein each actuating assembly is arranged to apply a resistive force throughout a range of pivotal movement of the respective blade body between the working position and the deflected position in which the prescribed holding force of the actuating assembly in the working position is greater than the resistive force at an intermediate position between the working position and the deflected position.

* * * * *